US005454711A

United States Patent [19]

Willems

[11] Patent Number: 5,454,711

[45] Date of Patent: Oct. 3, 1995

[54] BURNER FOR PULSATING COMBUSTION

[75] Inventor: Wilhelmus P. Willems, Schimmert, Netherlands

[73] Assignee: De Stichting Impuls, Schimmert, Netherlands

[21] Appl. No.: 50,485

[22] PCT Filed: Nov. 19, 1991

[86] PCT No.: PCT/NL91/00231

§ 371 Date: May 18, 1993

§ 102(e) Date: May 18, 1993

[87] PCT Pub. No.: WO92/08928

PCT Pub. Date: May 29, 1992

[30] Foreign Application Priority Data

Nov. 19, 1990 [NL] Netherlands ..... 9002525

[51] Int. Cl.[6] ..... F23C 11/04

[52] U.S. Cl. ..... 431/1; 122/24

[58] Field of Search ..... 431/1; 122/24; 60/39.77

[56] References Cited

U.S. PATENT DOCUMENTS

| | | | |
|---|---|---|---|
| 2,911,957 | 11/1959 | Kumm | 431/1 |
| 3,166,904 | 1/1965 | Meleneic | 60/39.77 X |
| 4,568,264 | 2/1986 | Mullen et al. . | |
| 4,762,487 | 8/1988 | Zappa | 431/1 |
| 4,919,085 | 4/1990 | Ishiguro . | |
| 4,968,244 | 11/1990 | Movassaghi | 431/1 |
| 4,993,938 | 2/1991 | Thrasher et al. | 431/1 |

FOREIGN PATENT DOCUMENTS

| | | | |
|---|---|---|---|
| 1039035 | 10/1953 | France | 60/39.77 |
| 7828122 | 10/1977 | France . | |
| 2404811 | 10/1978 | France . | |
| 0158404 | 9/1983 | Japan | 431/1 |
| 0159506 | 8/1985 | Japan | 431/1 |
| 402130302 | 5/1990 | Japan | 431/1 |
| 89-01416 | 1/1991 | Netherlands | F23C 11/04 |
| 0826137 | 5/1981 | U.S.S.R. | 43/1 |
| 1601455 | 10/1990 | U.S.S.R. | 431/1 |
| 757852 | 8/1954 | United Kingdom . | |
| 726995 | 3/1955 | United Kingdom | 431/1 |
| 1292605 | 9/1969 | United Kingdom . | |

*Primary Examiner*—Carl D. Price

*Attorney, Agent, or Firm*—Maxwell J. Petersen; Willian Brinks Hofer Gilson & Lione

[57] ABSTRACT

A burner for pulsating combustion includes an explosion chamber which on the inlet side connects on to a supply tube for combustion air and a supply tube for fuel. On the outlet side is connected one or more discharge tubes for the combustion gases. The invention provides a burner for pulsating combustion which produces considerably less noise than the known devices. This is achieved by providing the explosion chamber with a widening on the outlet side and connecting the discharge tube(s) to this widening at or close to the periphery thereof.

16 Claims, 4 Drawing Sheets

BURNER FOR PULSATING COMBUSTION

BACKGROUND OF THE INVENTION

1. Field of the Invention

The invention relates to a burner for pulsating combustion with an explosion chamber which on the inlet side connects to a supply tube for combustion air and a supply tube for fuel and on the outlet side is connected to one or more discharge tubes for the combustion gases, as described in the Netherlands patent application NL-A-89 01416 of applicant.

2. Description of the Prior Art

In such a burner as described in Netherlands patent application NL-A-89 01416, the explosion chamber and the supply and discharge tubes serving as resonance tubes are dimensioned such that the frequency of the periodic ignitions of the combustible mixture in the explosion chamber corresponds with the natural frequency of the gas mass in these tubes and the explosion chamber.

Due to the inertia of the gases flowing in the discharge tube there results an underpressure in the explosion chamber after combustion, whereby on the one side fuel and air are drawn in and on the other side hot combustion gases flow back to the explosion chamber which ignite the combustible mixture that has flowed in. A cyclic process hereby results which pulsates with a frequency substantially dependent on the dimensions of the explosion chamber, the supply and discharge tubes and the nature of the fuel.

Such devices are employed for heating, drying, concentration by evaporation, driving gas turbines, etc. and have the advantage of a high heat transfer coefficient, whereby the device can take a compact form while a practically complete combustion is obtained at an air factor 1 with almost no emission of CO and very little formation of $NO_x$.

In non-damped embodiments the explosion of the fuel produces a great deal of noise (between 90 and 140 db(A)), which produces a nuisance for the surrounding area.

SUMMARY OF THE INVENTION

The invention has for its object to provide a burner for pulsating combustion which produces considerably less noise than the known devices.

According to the invention this object is achieved by providing the explosion chamber with a widening on the outlet side and connecting the discharge tube(s) to this widening at or close to the periphery thereof. In this widening, which preferably extends perpendicularly of the centre line of the explosion chamber, explosion waves are reflected back and forth between the walls of this widening whereby the noise emission is markedly decreased.

The widening preferably has a shape such that the sound waves of successive explosions are shifted a half phase or an odd number of half phases relative to each other. The explosion noise is hereby suppressed by antinoise in counter phase. Use of the invention results in a noise reduction of 15 to 20 db(A).

Further advantages of the invention lie in the enlargement of the heat transfer surface in the high temperature zone, whereby less heating surface can suffice and it is possible to embody the outlet tubes shorter than in the known constructions without this widening.

BRIEF DESCRIPTION OF THE DRAWINGS

The invention is further elucidated with reference to the embodiments shown in the drawings, wherein.

DETAILED DESCRIPTION OF THE PRESENTLY PREFERRED EMBODIMENTS

Figure 1:
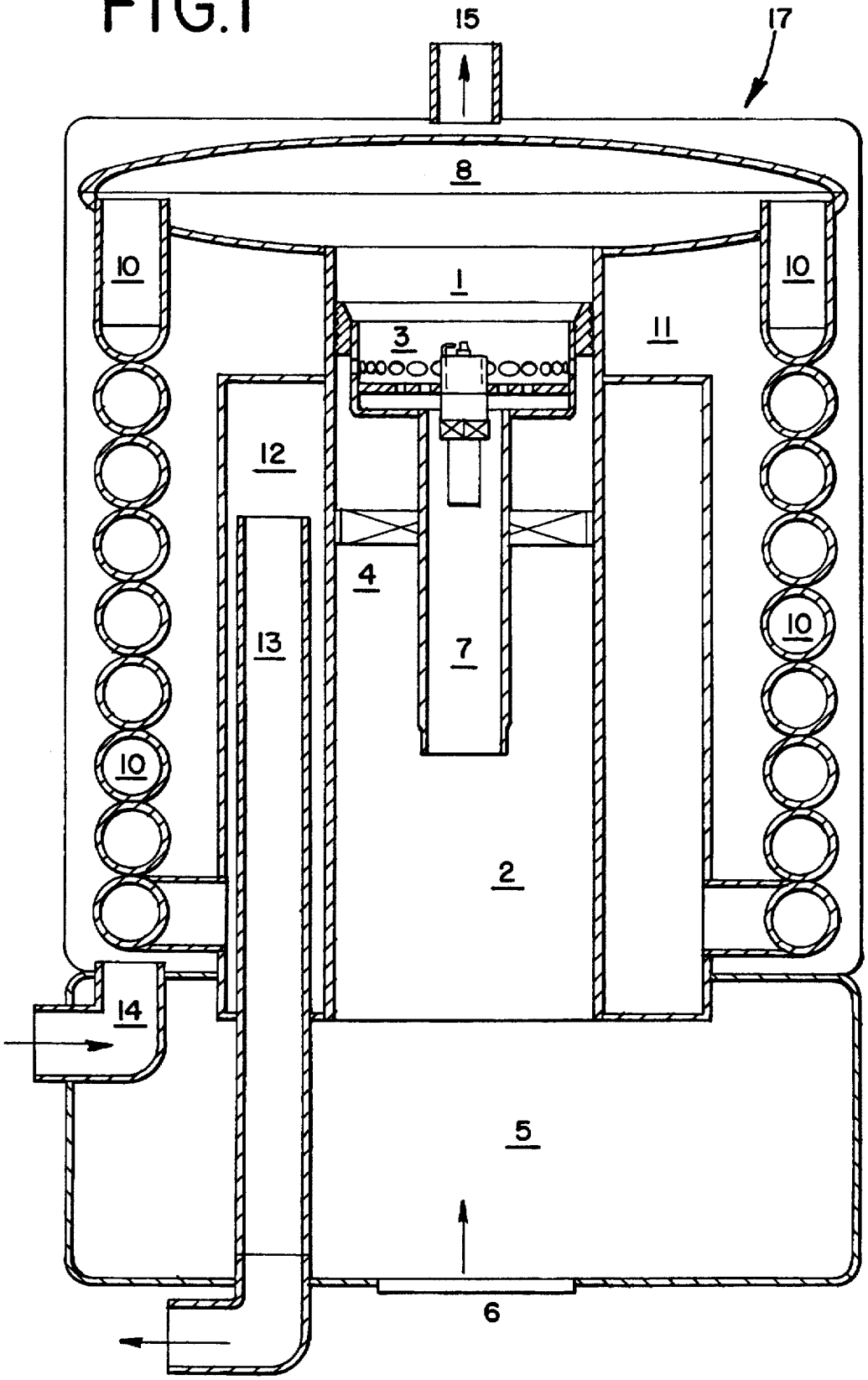
FIG. 1 shows a longitudinal section of a boiler for heating liquid, which is provided with a burner according to the invention.

For the sake of clarity functionally equivalent components are designated as far as possible in all the figures with the same reference numerals.

Figure 2:
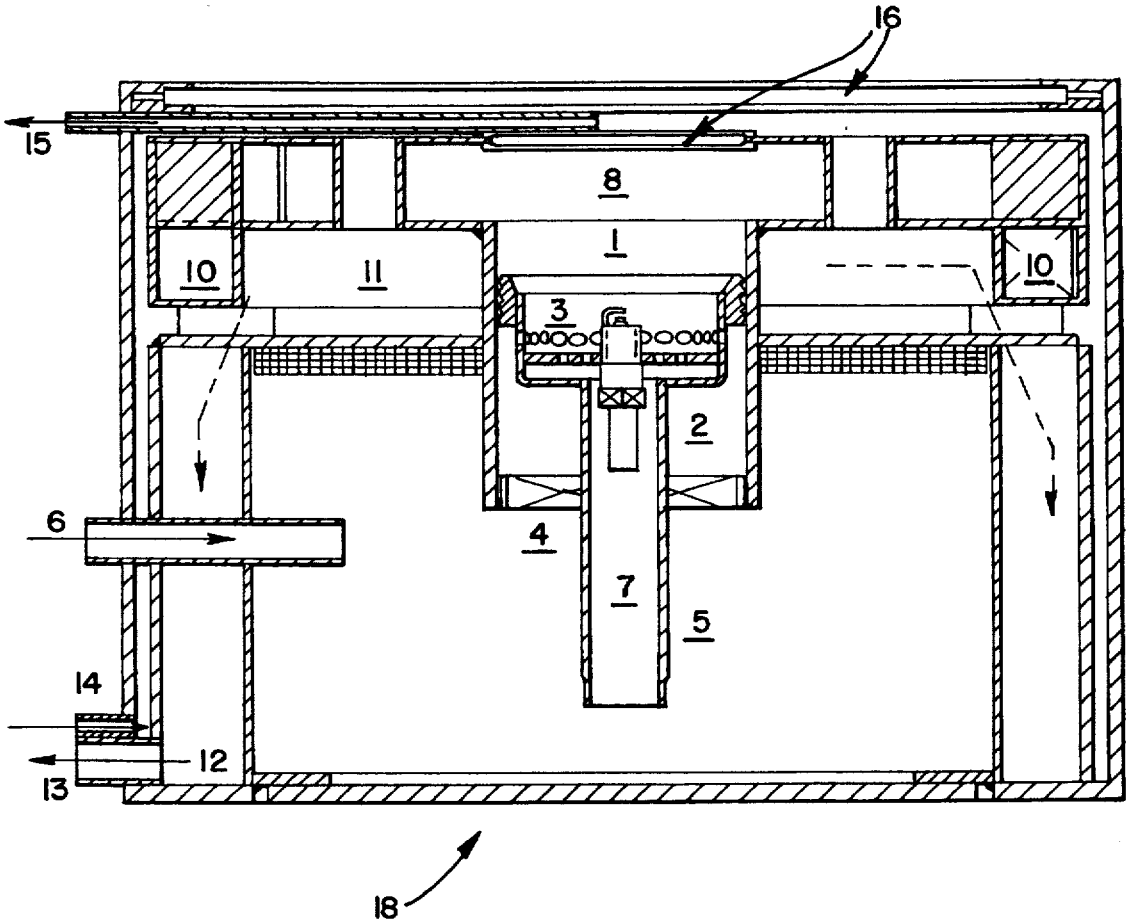
FIG. 2 shows a longitudinal section through a boiler wherein the outlet tubes of the burner form part of the widening and the device is further provided with inspection windows for observing the explosive combustion that occurs.

The boilers 17 and 18 respectively shown in FIGS. 1 and 2 contain an explosion chamber 1 which forms part of an air feed tube 2 but is separated therefrom by a burner head 3. Situated in the air feed tube 2 is a schematically depicted check valve section 4. The air feed tube 2 communicates with an air chamber 5 into which combustion air is supplied via an opening 6. Fuel is supplied to the explosion chamber via a tube 7 arranged centrally in the air feed tube 2. The tube 7 is connected to a fuel supply not shown in the drawing. The explosion chamber 1 is provided on the outlet side with a widening 8 which extends substantially perpendicularly of the centre line of the explosion chamber, so that the explosion chamber 1, 8 is mushroom-shaped. The widening is connected close to the outer periphery onto four discharge tubes 10.

The combustion takes place in the explosion chamber 1 and the widening 8 from which the combustion gases flow via the widening 8 and the discharge tubes 10, which extend helically in a liquid jacket 11, to a decoupling chamber 12.

The decoupling chamber 12 has the function of acoustically decoupling the resonance system 1, 8 from any other tubes (outlet systems and the like) that may be coupled to the device. Any condensate that may have been carried along can be drawn off in the decoupling chamber 12. The combustion gases then pass to the outside via flue discharge tube 13. The liquid for heating 11 flows inside via an opening 14 in the liquid jacket 11 and leaves this at the top via an opening 15.

In the embodiment 17 drawn in FIG. 1 the widening 8 is lens-shaped. The shape of the widening 8 can however be chosen at random within certain margins. The diameter of the widening 8 is so large that the sound wave returning after the collision with the peripheral wall is shifted a half phase or a number of odd half phases relative to the wave front of the explosion wave.

The diameter/height ratio of the widening 8 is further preferably such that the sound waves reflect back and forth between the walls of the widening. A part of the sound energy is hereby absorbed.

With use of the adjustable burner chamber as described in the Netherlands patent application NL-A-89 01416 of applicant the frequency can be adapted in simple manner whereby the sound waves of successive explosions can be shifted a half phase or an odd number of half phases relative to each other in simple manner without constructional operations being necessary.

In the embodiment drawn in FIG. 2 the widening 8 has a box-like form and the discharge tubes 10 are formed integrally with the widening 8. Inspection windows 16 are further arranged in the wall of the widening 8 and of the liquid jacket 11 for observing the combustion.

This is possible because the discharge tubes 10 connect to the explosion chamber 1 on the peripheral edge of the widening 8.

Figure 3:
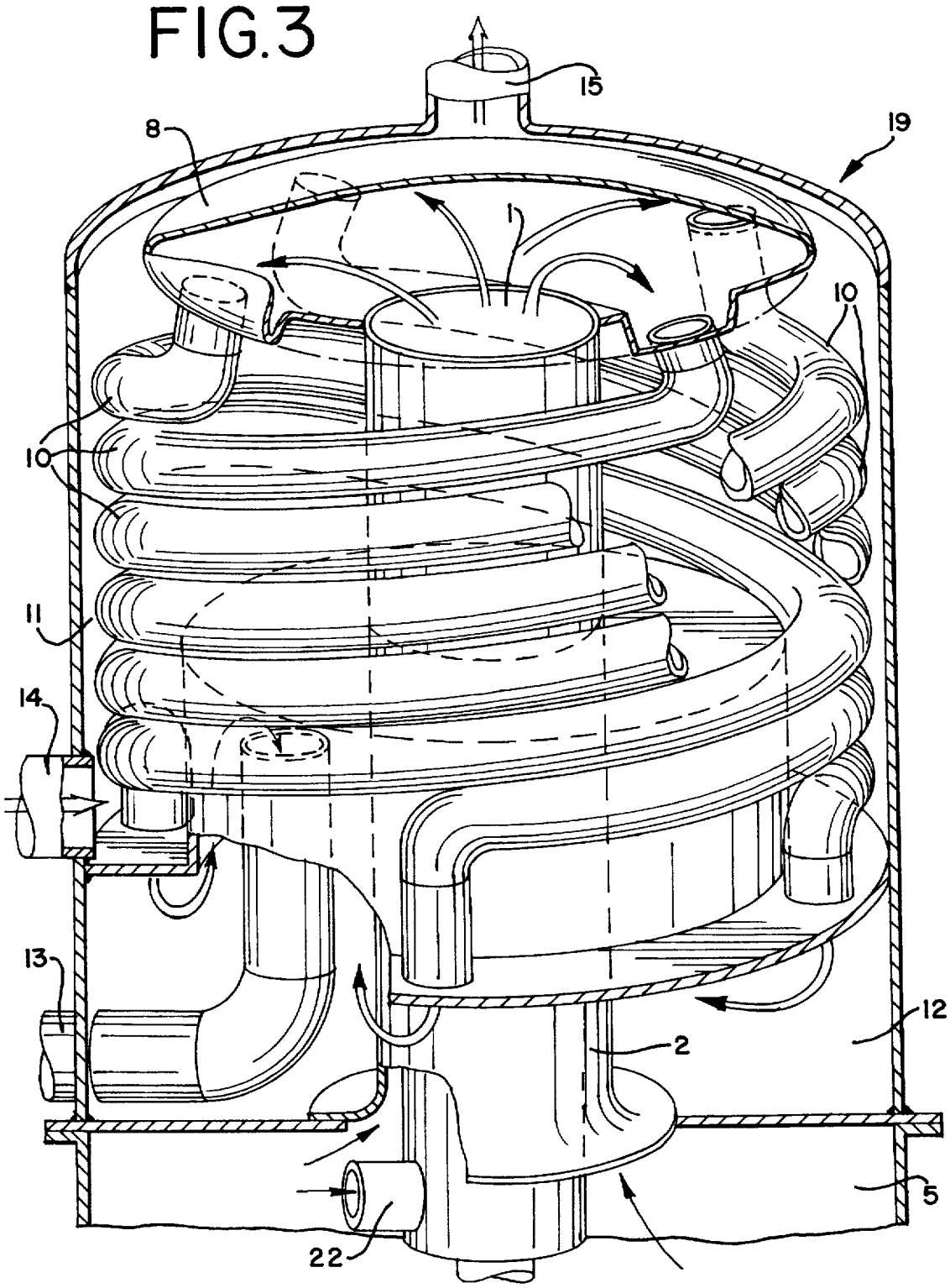
FIG. 3 shows a cut away perspective view of a further embodiment of the boiler according to the invention.

FIG. 3 shows a boiler 19. The technical embodiment is substantially the same as that of the boiler 17 according to FIG. 1. It will be apparent that this boiler 19 comprises four discharge tubes 10 which are positioned helically in interleaving relationship with small clearance. This ensures a large heat exchanging surface in the liquid jacket 11.

Figure 4:
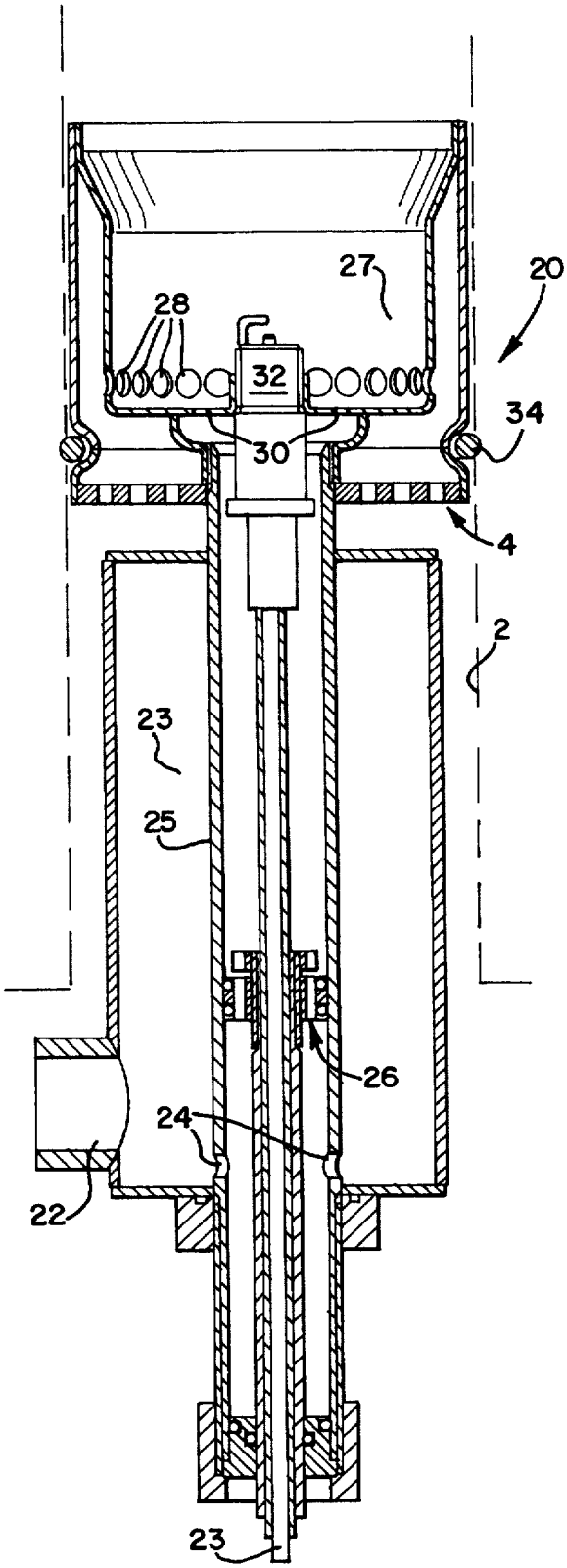
FIG. 4 shows a burner head in cross section.
Figure 5:
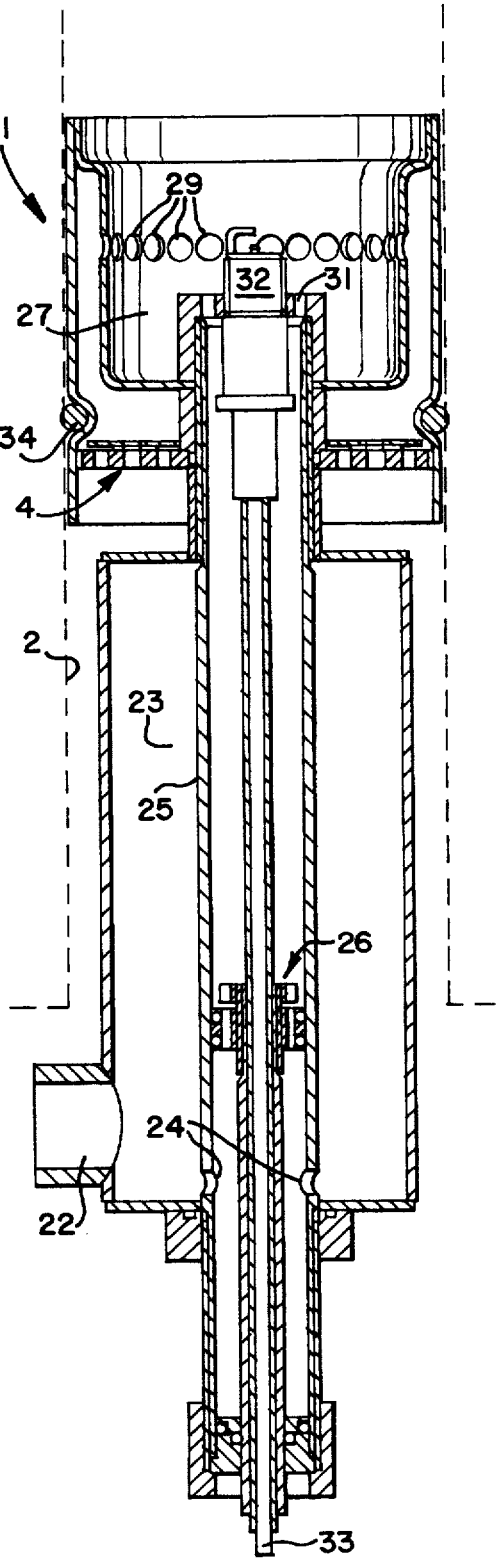
FIG. 5 shows another embodiment of a burner head in cross section.

FIGS. 4 and 5 show burner heads 20 and 21 respectively.

Gas-form fuel is supplied via a gas feed tube 22. This connects to a cylinder casing-like buffer space 23 which is communicates via an annular arrangement of openings 24 with a central tube 25 in which is situated a check valve section 26. This latter prevents flow-back of gas or combustion gases as a result of the combustion occurring in the explosion chamber.

Via the check valve section 4 combustion air can enter a mixing chamber 27 which is provided for this purpose with an annular arrangement of air supply openings. In the embodiment according to FIG. 4 the openings 28 are placed on the underside of the mixing chamber 27, while in the embodiment according to FIG. 5 they are arranged higher. The fuel is admitted into the mixing chamber 27 via the respective fuel supply openings 30 (FIG. 4) and 31 (FIG. 5).

A spark plug 32 receiving voltage from an external connection 33 is situated in the mixing chamber 27 for initiating the combustion.

The burner heads 20, 21 are sealingly received in the air feed tube 2 shown in FIG. 1 and are provided therefor with a sealing ring 34.

Attention is drawn to the fact that the noise reduction to be achieved with the invention greatly depends on the dimensioning of the boiler.

The burner heads according to FIGS. 4 and 5 are very easily replaceable. This is of great importance since due to the nature of the boilers according to the invention repairs have to be carried out by specialized personnel.

The structure according to the invention offers a very considerable noise reduction due to the decoupling chamber 12 and the flue discharge tube 13 (see FIG. 1), which together can form a suitable resonance system which is tuned such that an additional noise reduction is also obtained. The air chamber 5 moreover also contributes as intake buffer to a reduction in the noise production.

If desired, use can also be made of per se known acoustic damping material.

In a manner per se known for instance from motor technique, use could also be made of exhaust damping systems which can be based on noise suppression by destructive interference, damping using acoustic damping material or combinations thereof.

I claim:

1. A burner for pulsating combustion, comprising:

an explosion chamber including an inlet side connected to a supply tube for combustion air and a supply tube for fuel, and an outlet side connected to at least one discharge tube for combustion gases, the inlet side having a relatively narrow width, the outlet side including a widening having a greater width than the inlet side, said at least one discharge tube being connected to the widening, the widening being defined by walls which extend to said greater width and which are joined at peripheral edges thereof such that sound waves generated by successive explosions are shifted an odd number of half phases relative to each other, and are reflected back and forth between the walls of the widening.

2. The burner as claimed in claim 1, wherein the widening extends substantially perpendicularly of a centre line of the explosion chamber.

3. The burner as claimed in claim 1, wherein at least one discharge tube is formed integrally with the widening of the explosion chamber.

4. The burner as claimed in claim 1, further comprising an inspection window that is arranged in one of said walls of the widening.

5. The burner as claimed in claim 1, further comprising a decoupling space for the discharge of combustion gases.

6. The burner as claimed in claim 1, further comprising a decoupling space for the intake of combustion gases.

7. A burner for pulsating combustion, comprising:

an explosion chamber including an inlet side connected to a supply tube for combustion air and a supply tube for fuel, and an outlet side connected to at least one discharge tube for combustion gases, the inlet side having a relatively narrow width, the outlet side including a widening elongated substantially perpendicular to a center line of the chamber and extending beyond the width of the inlet side, said at least one discharge tube being connected to the widening, the widening being defined by walls joined at peripheral edges thereof such that sound waves generated by successive explosions are reflected back and forth between the walls of the widening, thereby reducing noise from the explosions.

8. The burner as claimed in claim 7, wherein at least one discharge tube is formed integrally with the widening of the explosion chamber.

9. The burner as claimed in claim 7, further comprising an inspection window that is arranged in one of said walls of the widening.

10. The burner as claimed in claim 7, further comprising a decoupling space for the discharge of combustion gases.

11. The burner as claimed in claim 7, further comprising a decoupling space for the intake of combustion gases.

12. A burner for pulsating combustion, comprising:

an explosion chamber including an inlet side connected to a supply tube for combustion air and a supply tube for fuel, and an outlet side connected to at least one supply tube for combustion gases, the inlet side having a relatively narrow width, the outlet side including a rectangular widening extending beyond the width of the inlet side, said at least one discharge tube being connected to the widening, the widening including generally opposed walls which extend substantially perpendicular to a center line of the explosion chamber and end walls joining said generally opposed walls.

13. The burner as claimed in claim 12, wherein at least one discharge tube is formed integrally with rectangular the widening of the explosion chamber.

14. The burner as claimed in claim 12, further comprising an inspection window that is arranged one of the end wall of the rectangular widening.

15. The burner as claimed in claim 12, further comprising a decoupling space for the discharge of combustion gases.

16. The burner as claimed in claim 12, further comprising a decoupling space for the intake of combustion gases.

* * * * *

UNITED STATES PATENT AND TRADEMARK OFFICE

CERTIFICATE OF CORRECTION

PATENT NO. : 5,454,711
DATED : October 3, 1995
INVENTOR(S) : Wilhelmus P. Willems It is certified that error appears in the above-indentified patent and that said Letters Patent is hereby corrected as shown below:

Col. 4,
In claim 13, line 2, delete "rectangular the" and substitute --the rectangular--.
Col. 5,
In claim 14, line 2, after "arranged" insert --in--

Signed and Sealed this

Sixteenth Day of April, 1996

Bruce Lehman

BRUCE LEHMAN

*Commissioner of Patents and Trademarks*

*Attest:*

*Attesting Officer*